US009943109B2

(12) United States Patent
Chen

(10) Patent No.: US 9,943,109 B2
(45) Date of Patent: Apr. 17, 2018

(54) ELECTRONIC CIGARETTE

(71) Applicant: Shenzhen Smoore Technology Limited, Shenzhen, Guangdong (CN)

(72) Inventor: Zhiping Chen, Shenzhen (CN)

(73) Assignee: Shenzhen Smoore Technology Limited, Shenzhen (CN)

( * ) Notice: Subject to any disclaimer, the term of this patent is extended or adjusted under 35 U.S.C. 154(b) by 412 days.

(21) Appl. No.: 14/685,623

(22) Filed: Apr. 14, 2015

(65) Prior Publication Data

US 2015/0342256 A1 Dec. 3, 2015

(30) Foreign Application Priority Data

May 30, 2014 (WO) ..... PCT/CN2014/078991

(51) Int. Cl.
*A24F 47/00* (2006.01)
*H05B 3/06* (2006.01)
*H05B 3/16* (2006.01)

(52) U.S. Cl.
CPC ..... *A24F 47/008* (2013.01); *H05B 3/06* (2013.01); *H05B 3/16* (2013.01); *H05B 2203/014* (2013.01); *H05B 2203/021* (2013.01); *H05B 2203/022* (2013.01)

(58) Field of Classification Search
CPC ..... A24F 47/008; A61M 15/0035; A61M 15/0036; A61M 15/004; A61M 15/0041
USPC ..... 131/184, 348; 128/202.21
See application file for complete search history.

(56) References Cited

U.S. PATENT DOCUMENTS 4,465,202 A * 8/1984 Stoves ..... F16J 13/12 220/203.06
5,337,740 A * 8/1994 Armstrong ..... A61M 15/0028 128/203.12
2011/0277756 A1* 11/2011 Terry ..... A61M 15/06 128/202.21
2013/0312777 A1* 11/2013 Burghardt ..... A24F 47/002 131/329
2014/0283857 A1* 9/2014 Liu ..... A24F 47/008 131/329
2015/0040929 A1* 2/2015 Hon ..... A24F 47/008 131/329

FOREIGN PATENT DOCUMENTS

WO WO 2013/159245 * 10/2013 ..... A24F 47/00

* cited by examiner

*Primary Examiner* — Tu B Hoang
*Assistant Examiner* — Erin McGrath

(57) ABSTRACT

The present invention provides an electronic cigarette, including a cartridge, an atomizer device, and a cartridge fixing element to detachably connect the cartridge to the atomizer device. A cartridge body can be switched to be in a pre-mounting position and a mounting position to engage the cartridge fixing element. When in the pre-mounting position, a sealing element and a puncturing element of the cartridge are spaced by a certain distance or abut against each other, to ensure that a first sealing portion will not be punctured and E-liquid in the cartridge will not be contaminated before smoking. When in the mounting position, the installation of the cartridge is completed, a second sealing portion is punctured to communicate a liquid reservoir chamber with a liquid reservoir room, to allow the E-liquid in the liquid reservoir chamber to flow to the liquid reservoir room, and users can smoke.

14 Claims, 8 Drawing Sheets

ELECTRONIC CIGARETTE

CROSS-REFERENCE TO RELATED APPLICATIONS

The present application claims the benefit of PCT application No. PCT/CN2014/078991 filed on May 30, 2014, the contents of which are hereby incorporated by reference.

BACKGROUND

1. Technical Field

The present disclosure relates to products for smokers, and more particularly relates to an electronic cigarette.

2. Description of Related Art

Electronic cigarettes are also known as virtual cigarettes or electronic atomizer devices. The electronic cigarettes are usually used a substitute for cigarettes. The design and flavor of the electronic cigarettes are similar to that of the cigarettes, but harmful substances, such as tar and aerosol for example, do not exist in the electronic cigarettes.

The known electronic cigarettes generally include a casing, a drip tip having holes therein and arranged on the top of the casing, a cartridge connected to the drip tip and used for storing E-liquid, and a heating seat connected to the cartridge. The heating element of the heating seat is generally fiber ropes and nickel chromium. The fiber ropes is used to absorb the E-liquid in the cartridge, and the heating wire is used to atomize the E-liquid. For typical electronic cigarettes when the E-liquid in the cartridge is used up, there are two ways to fill up the cartridge with E-liquid again. One way is to remove the seat and then inject E-liquid to the cartridge, and the injection of E-liquid can be repeated. Another one is to remove the drip tip and then inject E-liquid to the cartridge, and the injection of E-liquid can be repeated.

For above-mentioned electronic cigarettes, E-liquid should be stored alone. However, if stored improperly, E-liquid is easy to be contaminated by bacteria. Also, injecting E-liquid to the cartridge repeatedly will cause the cartridge to be used repeatedly, thus the interior of the cartridge is easy to be contaminated by outside environment. Also, long-time storage of E-liquid will result in the breeding of bacteria or stale.

SUMMARY

The object of the present invention is to provide an improved electronic cigarette.

The electronic cigarette includes a cartridge, an atomizer device, and a cartridge fixing element to detachably connect the cartridge to the atomizer device. The cartridge includes a cartridge body, a smoke channel defined in the cartridge body, a liquid reservoir chamber formed in the cartridge body and having an opening therein, and a sealing element including a first sealing portion to seal the opening. The atomizer device includes a liquid reservoir room corresponding to the opening of the liquid reservoir chamber, and a puncturing element corresponding to the liquid reservoir room and to puncture the first sealing portion. The cartridge body is switched to be in a pre-mounting position and a mounting position to engage with the cartridge fixing element. When the cartridge body is in the pre-mounting position, the puncturing element and the first sealing portion are spaced by a certain distance or abut against each other. When the cartridge body is in the mounting position, the puncturing element punctures the first sealing portion to communicate the liquid reservoir chamber with the liquid reservoir room.

Wherein, the cartridge body includes a mounting portion capable of engaging with the cartridge fixing element. A first latching portion protrudes from an outer sidewall of the mounting portion. The cartridge fixing element is cylindrical. A second latching portion and a third latching portion capable of engaging with the first latching portion respectively protrude from an inner sidewall longitudinally. When the mounting portion is in the pre-mounting position, the first latching portion engages with the second latching portion, and the puncturing element and the first sealing portion are spaced by a certain distance or abut against each other. When the mounting portion is in the mounting position, the first latching portion engages with the third latching portion, and the puncturing element punctures the first sealing element to communicate the liquid reservoir chamber with the liquid reservoir room.

Wherein, the first latching portion includes at least one latching protrusion protruding from the outer sidewall of mounting portion circumferentially. The second latching portion includes a first slot. The third latching portion includes a second slot. Both of the first slot and the second slot extend longitudinally, and the first slot nears an end of the cartridge. A first guiding slot and a second guiding slot are defined in the inner sidewall of the cartridge fixing element. The first guiding slot extends from an end of the cartridge fixing element opposite to the cartridge body to the first slot, and the second guiding slot communicates the first slot with the second slot.

Wherein, the first guiding slot and the second guiding slot are misaligned circumferentially.

Wherein, the first slot and the second slot are spaced longitudinally.

Wherein, the at least one latching protrusion includes two latching protrusions opposite to each other. The first guiding slot, the first slot, the second guiding slot, and the second slot respectively include two and are oppositely defined in two opposite sidewalls of the cartridge fixing element.

Wherein, the atomizer device further includes a seat. The cartridge fixing element is arranged on an end of the seat opposite to the cartridge and extends towards a sidewall of the cartridge.

Wherein, the sealing element further includes a second sealing portion to seal the smoke channel. The atomizer device further includes a snorkel corresponding to the smoke channel, and an exhaust pipe communicating with the snorkel. The exhaust pipe includes a puncturing portion to puncture the second sealing portion. When the mounting portion is in the pre-mounting position, the puncturing element and the second sealing portion are spaced by a certain distance or abut against each other. When the mounting portion is in the mounting position, the puncturing element punctures the second sealing portion to communicate the liquid reservoir chamber with the liquid reservoir room.

Wherein, the puncturing element includes at least one wedge-shape puncturing head towards the sealing element.

Wherein, the puncturing head includes a blade opposite to the first sealing portion. The blade is arc shaped and extends circumferentially with the axis of the atomizer device as the center.

Wherein, the puncturing head includes two opposite surfaces intersecting with each other to form the blade. The angle between the two opposite surfaces is acute.

Wherein, the cartridge further includes an elastic cover. The elastic cover includes a fixing portion and a moveable portion connected to the fixing portion. The fixing portion is secured to the cartridge body, and the moveable portion covers the opening elastically.

Wherein, the cartridge body includes a pipe to separate the liquid reservoir chamber from the smoke channel. The opening and the elastic cover are annular. The rim of an inner ring of the elastic cover is tightly sleeved on a free end of the pipe to form the fixing portion. The rim of an outer ring of the elastic cover extends laterally to a position near an inner sidewall of the outer ring of the liquid reservoir chamber to form the moveable portion.

Wherein, the atomizer device further includes an atomizer assembly. The atomizer assembly includes an absorption element and a heating element arranged on the absorption element. The absorption element is arranged within the snorkel laterally and at least one end extends to the liquid reservoir room. The absorption element includes a first absorption element the dimension of the section of which is greater and two second absorption elements. The dimension of the section of each of the second absorption elements is smaller, and the second absorption elements are arranged above the first absorption element side by side.

Wherein, the atomizer device further includes a first elastic sealing ring arranged between the outer rings of the liquid reservoir chamber and the liquid reservoir room.

The electronic cigarette described above has beneficial effects as below: when in the pre-mounting position, a sealing element and a puncturing element of the cartridge are spaced by a certain distance or abut against each other, to ensure that a first sealing portion will not be punctured and E-liquid in the cartridge will not be contaminated before smoking. When in the mounting position, the installation of the cartridge is completed, a second sealing portion is punctured to communicate a liquid reservoir chamber with a liquid reservoir room, to allow the E-liquid in the liquid reservoir chamber to flow to the liquid reservoir room, and users can smoke.

BRIEF DESCRIPTION OF THE DRAWINGS

In combination drawings with embodiments below to further illustrate the present invention, in the drawings.

DETAILED DESCRIPTION

For better understanding technical features, purpose and effect of the present invention, the following explanation in combination with drawings provides specific details for these embodiments of the present invention.

Figure 1:
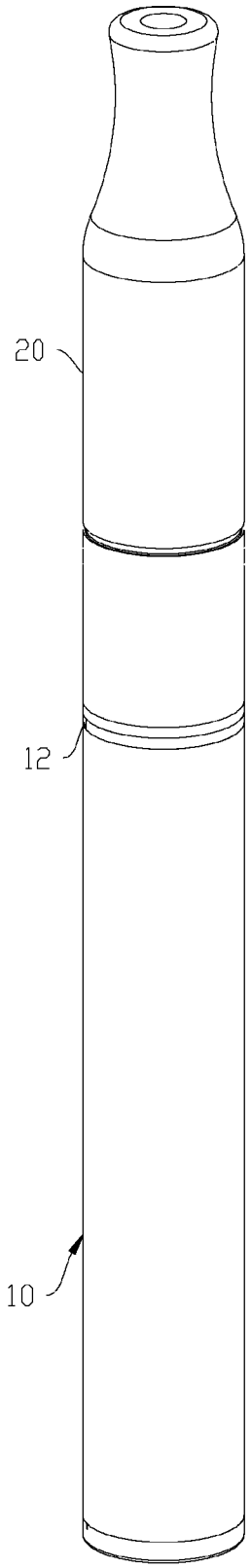
FIG. 1 is an isometric view of an electronic cigarette according to an embodiment of the present invention.
Figure 2:
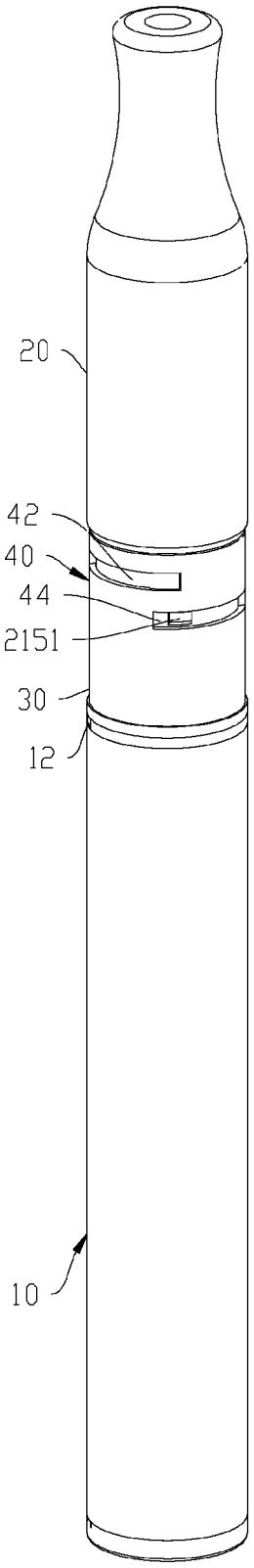
FIG. 2 is an isometric view of the electronic cigarette of FIG. 1 without a sleeve arranged the middle thereof.
Figure 3:
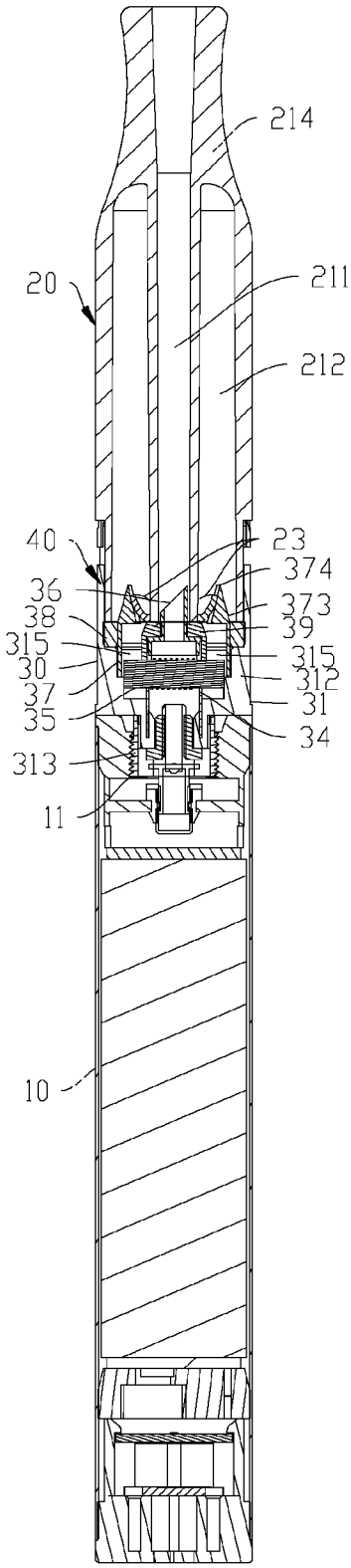
FIG. 3 is a cross-sectional view of the electronic cigarette of FIG. 2.

Referring to FIGS. 1-3, in a preferred embodiment of the present invention, an electronic cigarette includes a battery unit and an atomizer unit detachably mounted to the battery unit. In some embodiments, the battery unit may include a battery post 10, and the atomizer unit may include a cartridge 20, an atomizer device 30 detachably mounted to an end of the battery post 10, and a cartridge fixing element 40 to detachably connect the cartridge 20 to the atomizer device 30.

In some embodiments, the battery post 10 may be cylindrical, and may include a screwed slot 11 defined at an end of the battery post 10 and an air inlet 12 defined at a rim portion of the end. The threaded slot 11 allows the atomizer device 30 to be treaded into the screwed slot 11, thus connecting the atomizer device 30 to the battery post 10 mechanically and electrically. The air inlet 12 allows outside air to be inhaled into the battery post 10 and enter the atomizer device 30 via the battery post 10.

Figure 4:
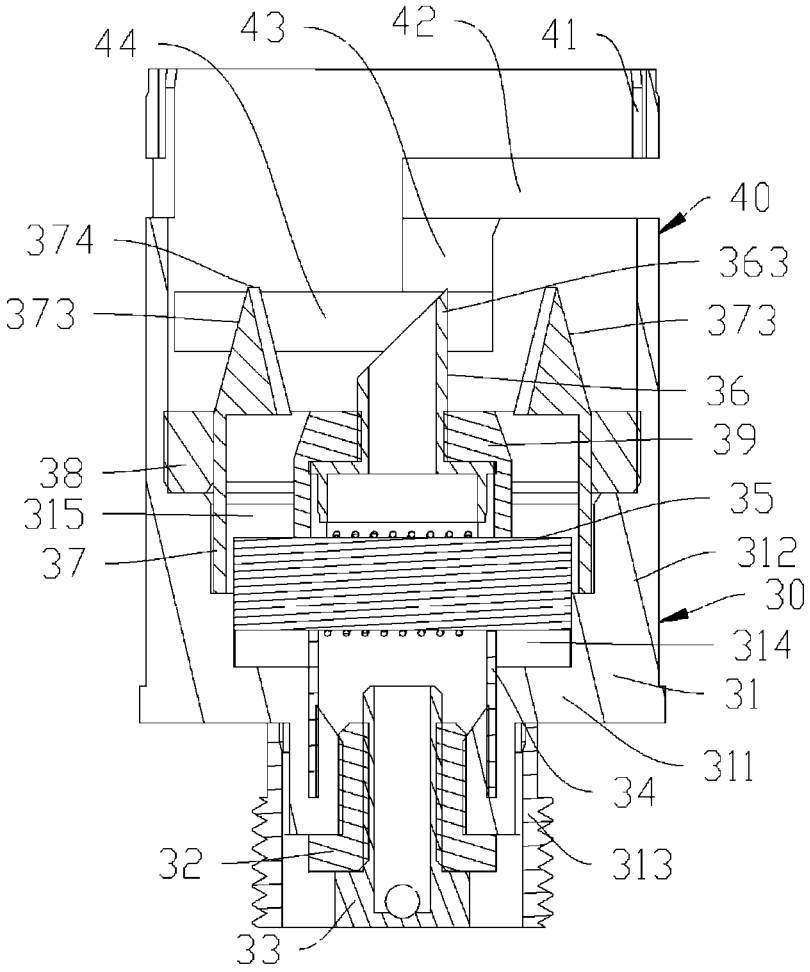
FIG. 4 is an enlarged view of an atomizer device of FIG. 3.
Figure 5:
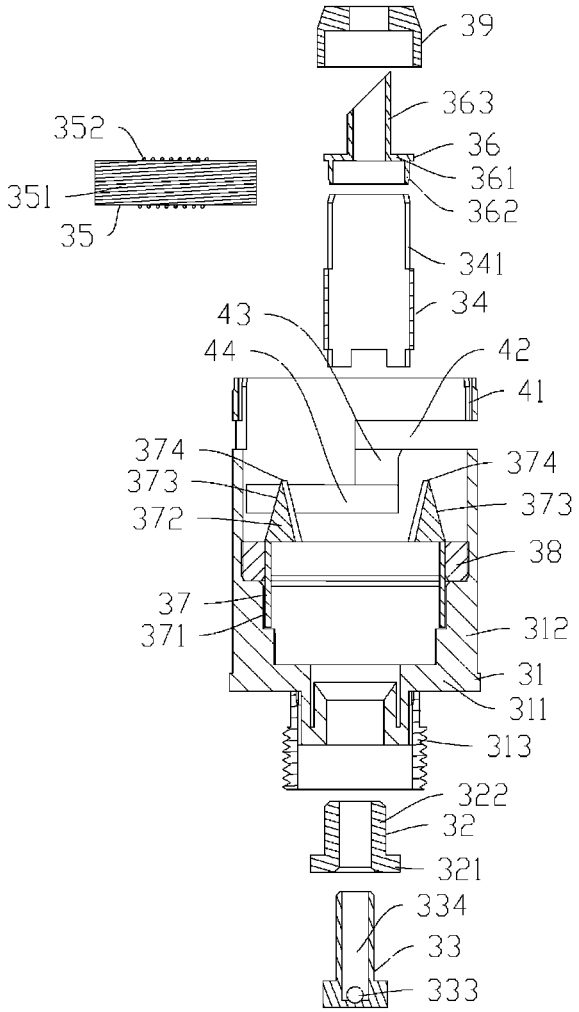
FIG. 5 is an exploded, perspective view of the atomizer device of FIG. 4.

Referring to FIGS. 4 and 5, in some embodiments, the atomizer device 30 includes a seat 31 engaging with the screwed slot 11 of the battery post 10, and a cylindrical insulation element 32, a cylindrical conductive post 33, a snorkel 34, an atomizer assembly 35, an exhaust pipe 36, a sleeve 37, a first elastic sealing ring 38, and a second elastic sealing ring 39, which are all arranged on the seat 31.

The seat 31 in some embodiments may be integrally formed by conductive material, such as copper or aluminum for example, such that the seat 31 can be electrically connected to a heating wire 352 of the atomizer assembly 35. The base 31 includes a ring shaped bottom wall 311, a cylindrical sidewall 312 arranged on the periphery of the top surface of the ring shaped bottom wall 311, and a screwed tube 313 arranged at the middle of the bottom surface of the ring shaped bottom wall 311. The screwed tube 313 engages with the screwed slot 11 of the battery post 10.

The cylindrical insulation element 32 in some embodiments may be T-shaped, and may include a surbased and cylindrical head 321 and a cylindrical post portion 322 connected to the head 321. The post portion 322 is inserted into a central through hole of the screwed tube 313, and the head 321 abuts against the step of the central through hole of the screwed tube 313. The screwed tube 313 engages with the screwed slot 11 of the battery post 10 to electrically connect the atomizer device 30 to an electrode of the battery post 10.

The cylindrical conductive post 33 may be T-shaped, and may include a surbased and cylindrical head 331 and a cylindrical post portion 332. The head 331 defines a first through hole 333 laterally, and the post portion 332 defines a second through hole 334 longitudinally. The first through hole 333 communicates with the second through hole 334. The post portion 332 is inserted into the central through hole of the cylindrical insulation element 32, and the head 331 abuts against the bottom surface of the head 331 of the cylindrical insulation element 32, to direct air to enter the second through hole 334 via the first through hole 333.

The snorkel 34 is arranged on the middle of the top surface of the ring shaped bottom wall 311. The cylindrical sidewall 312, the ring shaped bottom wall 311, and the snorkel 34 cooperatively define a ring shaped receiving space 314. The central through hole of the ring shaped bottom wall 311 communicates with the central through hole of the screwed tube 313, to allow the air in the second through hole 334 to enter the central through hole of the snorkel 34. A free end of the snorkel 34 recesses to form a receiving slot 341 facing the ring shaped bottom wall 311 to receive the atomizer assembly 35. The cylindrical conductive post 33 in some embodiments is employed to electrically connect the atomizer assembly 35 to another electrode of the battery post 10.

The atomizer assembly 35 in some embodiments may be arranged in the receiving slot 341 of the snorkel 34 laterally, and may include an absorption element and a heating element arranged on the absorption element. The absorption element includes a first absorption element 351 the dimension of the section of which is greater, and two second absorption elements (not shown). The dimension of the section of each second absorption element is smaller, and the second absorption elements are arranged above the first absorption element 351 side by side. The heating element includes the heating wire 352 encircling the portion of the first absorption element 351 arranged within the snorkel 34. The first absorption element 351 and the second absorption elements may be made of material with better absorption capability, such as glass fiber or natural fiber for example. It can be understood that in some embodiments some other heating element, for example a heating sheets, can be used to replace the heating wire 352. In addition, the second absorption elements can be absent from the absorption element.

The exhaust pipe 36 in some embodiments may include a ring shaped baseboard 361, an embedding portion 362 extending from the bottom surface of the ring shaped baseboard 361, and a cylindrical puncturing portion 363 extending from the top surface of the ring shaped baseboard 361. The outer diameter of the ring shaped baseboard 361 is greater than the aperture of an inner hole defined on the top of the snorkel 34. The outer diameter of the embedding portion 362 accommodates the aperture of the inner hole defined on the top of the snorkel 34, to allow the exhaust pipe 36 to be embedded into the inner hole defined on the top of the snorkel 34 from the embedding portion 362, and to make the ring shaped baseboard 361 to be on the top surface of the snorkel 34. The puncturing portion 363 is used to puncture a sealing element 22 of the cartridge 20 and extends into the smoke channel 211 of the cartridge 20.

Figure 6:
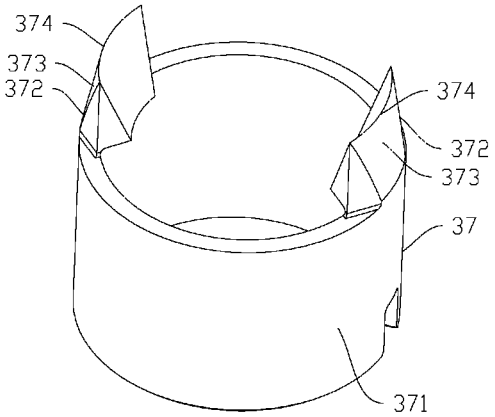
FIG. 6 is an isometric view of the sleeve of FIG. 5.

Referring to FIG. 6, the sleeve 37 in some embodiments may include a sleeve body 371 and a pair of puncturing elements 372 oppositely arranged on the top rim of the sleeve body 371. There may be one or more puncturing elements 372. The outer diameter of the sleeve body 371 accommodates the inner diameter of the cylindrical sidewall 312 of the seat 31, to allow the sleeve body 371 to be tightly arranged in the receiving space 314. When the sleeve body 371 is tightly arranged in the receiving space 314, the sleeve body 371, the ring shaped bottom wall 311 of the seat 31, and the snorkel 34 cooperatively define a liquid reservoir room 315 to reserve E-liquid. Two ends of the first absorption element 351 and the second absorption elements of the atomizer assembly 35 respectively extend into the liquid reservoir room 315, absorbing the E-liquid of the liquid reservoir room 315 to the middle to be atomized by the heating wire 352. It is noteworthy that in some embodiments only one end of the first absorption element 351 and/or the second absorption elements extends into the liquid reservoir room 315.

The pair of puncturing elements 372 are used to puncture the sealing element 22 of the cartridge 20 to communicate a liquid reservoir chamber 212 of the cartridge 20 with the liquid reservoir room 315, thus the E-liquid in the liquid reservoir chamber 212 can flow to the liquid reservoir room 315. Each puncturing element 372 includes a wedge-shape puncturing head 373 towards the sealing element 22, to cause the puncturing element 372 to be just above the liquid reservoir room 315. In some other embodiments, each puncturing element 372 may include two or more wedge-shape puncturing heads 373. Each puncturing head 373 includes a blade 374 opposite to a first sealing portion 221 of the cartridge 20. The blade 374 is arc shaped, and extends circumferentially with the axis of the atomizer device 30 as the center. The puncturing head 373 further includes two opposite surfaces intersecting with each other to form the blade 374. The angle between the two opposite surfaces is acute. The sleeve 37 is used for better configuring the first elastic sealing ring 38 and the puncturing elements 372, to decrease the difficulty in forming the seat 31. It can be understood that in some conditions the sleeve 37 and the seat 31 can be integrally formed.

The first elastic sealing ring 38 in some embodiments may be cylindrical and tightly sleeved on the sleeve 37 to expose the puncturing elements 372 outside. The bottom end of the first elastic sealing ring 38 abuts against the cylindrical sidewall 312, and the top end engages with the cylindrical casing of the cartridge 20. That is, the first sealing ring 38 seals a space between the outer rings of the liquid reservoir chamber 212 and the liquid reservoir room 315, to improve the sealing effect between the first elastic sealing ring 38 and the cylindrical casing, and exert an elastic force on the cylindrical casing to make the cylindrical casing be away from the atomizer assembly 35. The first elastic sealing ring 38 includes a rippled outer wall to improve the sealing effect between the first elastic sealing ring 38 and the inner wall of the cartridge fixing element 40 when a pressure is exerted on the atomizer assembly 35.

The second elastic sealing ring 39 in some embodiments may be also cylindrical and tightly sleeved on the outer periphery of the puncturing portion 363 of the exhaust pipe 36 to expose the pointed end of the puncturing portion 363 outside. The second elastic sealing ring 39 engages with the pipe of the cartridge 20, that is, the second elastic sealing ring 39 is arranged between the inner rings of the liquid reservoir chamber 212 and the liquid reservoir room 315 to improve the sealing effect between the second elastic sealing ring 39 and the pipe, preventing the E-liquid in the liquid reservoir room 315 from leaking to the smoke channel 211.

Figure 7:
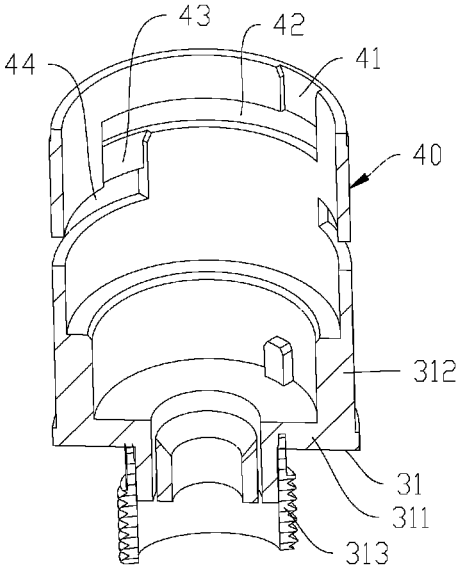
FIG. 7 is an isometric view of a seat and a cartridge fixing element of FIG. 5.

Referring to FIG. 7, the cartridge fixing element 40 in some embodiments may be made of transparent material to facilitate users to observe the cartridge 20. The cartridge fixing element 40 may be cylindrical and arranged on one end of the seat 31 opposite to the cartridge 20. The cartridge fixing element 40 extends towards one sidewall of the cartridge 20 from the cylindrical sidewall 312, to facilitate the installation of the first elastic sealing ring 38 and the sealing element 22, and also ensure the sealing effect. In other embodiments, the cartridge fixing element 40 may be sleeved on the cylindrical sidewall 312.

A second latching portion and a third latching portion are arranged on the inner wall of the cartridge fixing element 40 symmetrically and longitudinally, and are capable of engaging with a first latching portion of the cartridge 20. The second latching portion includes a first slot 42, and the third latching portion includes a second slot 44. The first slot 42 and the second slot 44 both extend circumferentially and are arranged longitudinally, and the first slot 42 nears one end of the cartridge 20.

The inner sidewall of the cartridge fixing element 40 further defines a first guiding slot 41 extending from the end of the cartridge fixing element 40 opposite to a cartridge body 21 to the first slot 42, and a second guiding slot 43 communicating the first slot 42 with the second slot 44. Furthermore, there are a pair of first guiding slots 41, a pair of first slots 42, a pair of second guiding slots 43, and a pair of second slots 44, and each pair are symmetrically defined in two opposite sidewalls of the cartridge fixing element 40 to ensure the stability of the cartridge 20 after the cartridge 20 is mounted to the cartridge fixing element 40. Furthermore, the first slot 42 and the second slot 44 are spaced longitudinally, to ensure that there is a certain distance when the cartridge 20 is inserted from the first slot 42 to the second slot 44, thus to puncture the sealing element 22 and resist the elastic cover 23 until the elastic cover 23 is opened. The first slot 42 and the second slot 44 both extend circumferentially, to allow the cartridge 20 to rotate circumferentially within the cartridge fixing element 40 after the cartridge 20 is inserted into, thus preventing the cartridge 20 from coming off the first slot 42 and the second slot 44 accidentally. Preferably, the first guiding slot 41 and the second guiding slot 43 are misaligned circumferentially, to prevent the cartridge 20 from being inserted into the second slot 44 directly, or to prevent the cartridge 20 from coming off from the second slot 44 completely when the cartridge 20 is pulled.

Figure 8:
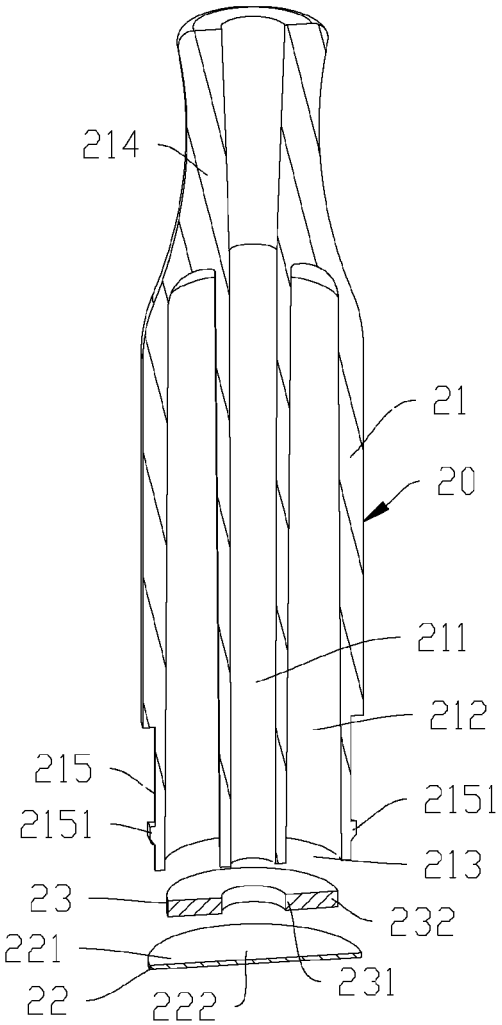
FIG. 8 is a cross-sectional view of a cartridge of FIG. 2.
Figure 9:
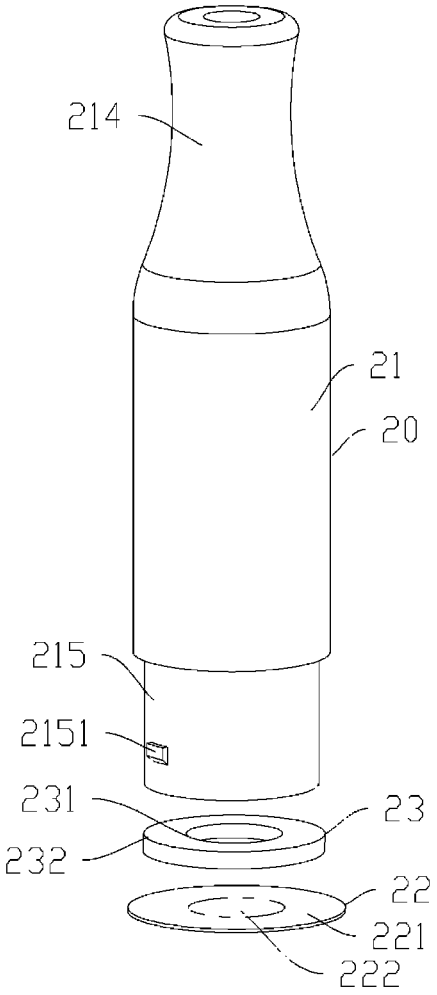
FIG. 9 is an exploded, perspective of the cartridge of FIG. 2.

Referring to FIGS. 8 and 9, the cartridge 20 in some embodiments may include the cartridge body 21, and the smoke channel 211 and the liquid reservoir chamber 212 arranged on the cartridge body 21. The liquid reservoir chamber 212 in some embodiments may include an opening 213 to communicate the liquid reservoir chamber 212 with the outside environment. Preferably, the smoke channel 211 extends through the cartridge body 21 longitudinally, and the liquid reservoir chamber 212 encircles the smoke channel 211. Correspondingly, the opening 213 is defined in one end of the cartridge body 21 and is annular.

The cartridge body 21 in some embodiments may be made of transparent material, to facilitate users to observe the quantity of the E-liquid in the liquid reservoir chamber 212 in real time. The cartridge body 21 includes a drip tip 214 and a mounting portion 215. The smoke channel 211 sequentially extends through the drip tip 214 and the mounting portion 215. The aperture of the portion of the smoke channel 211 within the drip tip 214 gradually increases along a direction towards a free end of the drip tip 214, thus the velocity of inhaling smoke gradually decreases to improve user's smoking experience. The drip tip 214 and the mounting portion 215 in some embodiments may be both substantially cylindrical. The drip tip 214 should be comfortable for users to smoke the electronic cigarette. The diameter of the mounting portion 215 is greater than the diameter of the drip tip 214, and accommodates the inner diameter of the cartridge fixing element 40, to allow the mounting portion 215 to be inserted into the cartridge fixing element 40.

In some embodiments, the cartridge body 21 is switched to be in a pre-mounting position and a mounting position to engage with the cartridge fixing element 40. When the cartridge body 21 is in the pre-mounting position, the puncturing element 372 and the first sealing portion 221 of the cartridge 20 are spaced by a certain distance or abut against each other. When the cartridge body 21 is in the mounting position, the puncturing element 372 punctures the first sealing portion 221 of the cartridge 20. Furthermore, the cartridge body 21 includes the mounting portion 215 capable of engaging with the cartridge fixing element 40. A first latching portion protrudes from the outer sidewall of the mounting portion 215, and includes a pair of latching protrusions 2151 protruding from the outer sidewall of the mounting portion 215 circumferentially. The pair of the latching protrusions 2151 respectively engage with the pair of the first slots 42 or the pair of the second slots 44. The first guiding slot 41 is used to guide the latching protrusion 2151 to be inserted into the first slot 42 or to be pulled out of the first slot 42. The second guiding slot 43 is used to guide the movement of the latching protrusion 2151 between the first slot 42 and the second slot 44.

In other embodiments, there is only one first guiding slot 41, one first slot 42, one second guiding slot 43, one second slot 44, and one latching protrusion 2151. At a specific unique angle, the latching protrusion 2151 can be mounted to the cartridge fixing element 40. The first latching portion may include an annular protrusion, and the second latching portion and the third latching portion may include annular recessed slots. When the cartridge 20 is inserted into the cartridge fixing element 40, the annular protrusion engages with the annular recessed slots of the second latching portion and the third latching portion in turn, to control the cartridge 20 to be in the longitudinal pre-mounting position and the longitudinal mounting position in turn. Certainly, the first latching portion, the second latching portion, and the third latching portion may be screw thread, and the cartridge 20 is rotated to be in the longitudinal pre-mounting position and the longitudinal mounting position in turn, to ensure the integrity of the sealing element 22 or to puncture the sealing element 22. In other embodiments, the sealing element 22 may be inclined, and the mounting portion 215 cooperates with the cartridge fixing element 40 to rotate circumferentially. The cartridge 20 is rotated circumferentially to be in the pre-mounting position and the mounting position in turn. The cartridge body 21 can be rotated to different orientations to cause the first sealing portion 221 to be integral and to be punctured.

The middle of the mounting portion 215 in some embodiments further include a pipe to separate the liquid reservoir chamber 212 from the smoke channel 211. The opening 213 is defined in a free end of the mounting portion 215. The cartridge 20 in some embodiments may further include the sealing element 22 to seal the opening 213. The sealing element 22 in some embodiments may be a circular sheet, and includes a first sealing portion 221 and a second sealing portion 222. The first sealing portion 221 is substantially ring shaped and used for sealing the opening 213 of the liquid reservoir chamber 212, and the second sealing portion 222 is substantially ring shaped and used for sealing the smoke channel 211. The sealing element 22 may be made of material with a certain strength and which is easily punctured, thus on one hand, before use, the E-liquid can be reserved in the liquid reservoir chamber 212 and cannot easily leak, on the other hand, the sealing element 22 can be easily punctured by an sharp object, thus the E-liquid can flow to the atomizer device 30. In some embodiments, the sealing element 22 may be made of foil paper. In other embodiments, the sealing element 22 may be made of plastic paper. It can be understood that the second sealing portion 222 can be absent from the sealing element 22.

The cartridge 20 in some embodiments may further include the elastic cover 23 arranged on the inner sidewall of the sealing element 22 and able to cover the opening 213 of the liquid reservoir chamber 212, thus the cover 23 covers the opening 213 when the sealing element 22 is punctured. The elastic cover 23 in some embodiments may be an annular sheet, and may be made of soft and elastic material for example silica gel. The outer diameter of the elastic cover 23 may be equal to or slightly less than the outer diameter of the liquid reservoir chamber 212. The rim of the inner ring of the elastic cover 23 is tightly sleeved on the free end of the pipe to form a fixing portion 231 of the elastic cover 23. The rim of the outer ring of the elastic cover 23 extends laterally to a position near the inner sidewall of the outer ring of the liquid reservoir chamber 212 to form a moveable portion 232 of the elastic cover 23. The rim of the outer ring can be turned over relative to the rim of the inner ring, thus the opening 213 of the liquid reservoir chamber 212 can expose outside when an external force is exerted on the rim of the outer ring, and the rim of the outer ring restores to again cover the opening 213 when the external force is removed.

The following description in combination with the assembly and use of the electronic cigarette further illustrates the present invention.

In some embodiments, the cartridge 20 may be sealed alone. That is, when delivered, the cartridge 20 has E-liquid therein and is sealed by the sealing element 22. To amount the cartridge 20 to the atomizer assembly 35, the cartridge 20 is held by hands and the mounting portion 215 is inserted into the cartridge fixing element 40. After insertion, the latching protrusion 2151 of the mounting portion 215 enters the first guiding slot 41 defined in the inner sidewall of the cartridge fixing element 40. The cartridge 20 is inserted longitudinally along the cartridge fixing element 40, and the latching protrusion 2151 will engage with the first slot 42 when the cartridge 20 is rotated. At this point, the puncturing element 372 and the first sealing portion 221 are spaced by a certain distance or abut against each other, and the puncturing element 363 and the second sealing portion 222 are spaced by a certain distance or abut against each other, to ensure that the sealing element 22 is integrated and is not be punctured, the E-liquid in the liquid reservoir chamber 212 will not flow outside, and the exhaust pipe 36 is separated from the smoke channel 211 to separate the liquid reservoir chamber 212 from the outside world, thus contamination or volatilization can be avoided.

When smoking, the cartridge 20 is rotated to cause the latching protrusion 2151 to be rotated to the second guiding slot 43. An external force is exerted to cause the cartridge 20 to be inserted longitudinally along the second guiding slot 43. The cartridge 20 is then rotated and the latching protrusion 2151 engages with the second slot 44. At this point, the puncturing element 372 punctures the first sealing portion 221, and the puncturing portion 363 punctures the second sealing portion 222. The puncturing element 372 resists the movable portion 232 of the elastic cover 23 to elastically turn over the moveable portion 232, thus the opening 213 exposes outside, and the E-liquid will flow to the liquid reservoir room 315 from the opening 213. It is noteworthy that when the mounting portion 215 is rotated relative to the cartridge fixing element 40, the puncturing element 372 can puncture the sealing portion 221 to form an arc puncture due to the special shape of the puncturing head 373, thus the E-liquid can flow to the liquid reservoir room 315 smoothly.

The first elastic sealing ring 38 made of silicone gel material has the sealing function, and can avoid leakage of the E-liquid from the gap between the mounting portion 215 and the cartridge fixing element 40. At the same time, the latching protrusion 2151 engages with the second slot 44 tightly due to the elastic force of the first elastic sealing ring 38, to prevent the cartridge 20 from coming out of the cartridge fixing element 40 when in use.

When the E-liquid flows to the liquid reservoir room 315, the E-liquid is absorbed by the first absorption element 351. At this point, the electronic cigarette can be used for smoking. The heating wire 352 of the atomizer assembly 35 is electrified and gives out heat to heat and atomize the E-liquid absorbed by the first absorption element 351 and the second absorption elements. At this point, when a user inhales from the drip tip 214 of the electronic cigarette, the breath flows to the battery post 10 via the air inlet 12, and sequentially passes through the first through hole 333 and the second through hole 334 of the cylindrical conductive post 33 to enter the snorkel 34 of the atomizer device 30. The airflow drives the smoke to flow to the mouth of the user by passing through the exhaust pipe 36 and the smoke channel 211.

When the E-liquid in the liquid reservoir room 315 is used up, the E-liquid in the liquid reservoir chamber 212 will continuously flow to the liquid reservoir room 315. To terminate smoking, the cartridge 20 is rotated reversely. When the latching protrusion 2151 corresponds to the second guiding slot 43, the cartridge 20 can be pulled out to cause the latching protrusion 2151 to engage with the first slot 42. At this point, the movable portion 232 of the elastic cover 23 is turned down to cover the opening 213 of the cartridge 20. Thus, the E-liquid in the liquid reservoir chamber 212 is sealed, to avoid volatilization, or deterioration due to contamination, or the breeding of bacteria. To smoke, the electronic cigarette can be used again when the latching protrusion 2151 is caused to engage with the second slot 44.

When the E-liquid in the liquid reservoir chamber 212 is used up, the cartridge 20 is rotated reversely to pull out of the cartridge 20. When the cartridge 20 is pulled to a position where the latching protrusion 2151 engages with the first slot 42, the elastic cover 23 restores to cover the opening 213 to prevent the remaining E-liquid from flowing to outside. The cartridge 20 is continuously rotated reversely. When the latching protrusion 2151 corresponds to the first guiding slot 41, the cartridge 20 can be pulled out, to avoid or significantly reduce the leakages of the remaining E-liquid. Therefore, contamination to the atomizer device 30, the cartridge fixing element 40, and user's hands caused by the E-liquid can be avoided when detaching the cartridge 20.

It is noteworthy that, the above-mentioned technical features can be used in any combination without restriction.

The disclosure described above of the present invention is illustrative but not restrictive scope of the present invention. Any equivalent structure, or equivalent process transformation, or directly or indirectly usage in other related technical field, all those be made in the same way are included within the protection scope of the present invention.

What is claimed is:

1. An electronic cigarette comprising: a cartridge (20) comprising a cartridge body (21), a smoke channel (211) defined in the cartridge body (21), a liquid reservoir chamber (212) formed in the cartridge body (21) and comprising an opening (213), and a sealing element (22) comprising a first sealing portion (221) to seal the opening (213); an atomizer device comprising: a liquid reservoir room (315) corresponding to the opening (213) of the liquid reservoir chamber (212); a puncturing element (372) corresponding to the liquid reservoir room (315) and to puncture the first sealing portion (221); and a cartridge fixing element (40) to detachably connect the cartridge (20) to the atomizer device (30); wherein, the cartridge body (21) is switched to be in a pre-mounting position and a mounting position to engage with the cartridge fixing element (40); when the cartridge body (21) is in the pre-mounting position, the puncturing element (372) and the first sealing portion (221) are spaced by a certain distance or abut against each other; when the cartridge body (21) is in the mounting position, the puncturing element (372) punctures the first sealing portion (221) to communicate the liquid reservoir chamber (212) with the liquid reservoir room (315); wherein the liquid reservoir chamber (212) surrounds the smoke channel (211) and is coaxial with the smoke channel (211), the sealing element (22) further comprises a second sealing portion (222) to seal the smoke channel (211); the atomizer device (30) further comprises a snorkel (34) corresponding to the smoke channel (211) and an exhaust pipe (34) communicating with the snorkel (34), the exhaust pipe (34) comprises a puncturing portion (363) to puncture the second sealing portion (222), when the mounting portion (215) is in the pre-mounting position, the puncturing portion (363) and the second sealing portion (222) are spaced by a certain distance or abut against each other; when the mounting portion (215) is in the mounting position, the puncturing portion (363) punctures the second sealing portion (222) to communicate the smoke channel (211) with the liquid reservoir room (315).

2. The electronic cigarette as described in claim 1, wherein the cartridge body (21) comprises a mounting portion (215) capable of engaging with the cartridge fixing element (40), a first latching portion protrudes from an outer sidewall of the mounting portion (215); the cartridge fixing element (40) is cylindrical, and a second latching portion and a third latching portion capable of engaging with the first latching portion respectively protrude from an inner sidewall longitudinally; when the mounting portion (215) is in the pre-mounting position, the first latching portion engages with the second latching portion, and the puncturing element (372) and the first sealing portion (221) are spaced by a certain distance or abut against each other; when the mounting portion (215) is in the mounting position, the first latching portion engages with the third latching portion, and the puncturing element (372) punctures the first sealing element (221) to communicate the liquid reservoir chamber (212) with the liquid reservoir room (315).

3. The electronic cigarette as described in claim 2, wherein the first latching portion comprises at least one latching protrusion (2151) protruding from the outer sidewall of the mounting portion (215) circumferentially; the second latching portion comprises a first slot (42), the third latching portion comprises a second slot (44), both of the first slot (42) and the second slot (44) extend circumferentially, and the first slot (42) nears an end of the cartridge (20); a first guiding slot (41) and a second guiding slot (43) are defined in the inner sidewall of the cartridge fixing element (40), the first guiding slot (41) extends from an end of the cartridge fixing element (40) adjacent to the cartridge body (21) to the first slot (42), and the second guiding slot (43) communicates the first slot (42) with the second slot (44) the first slot (42) and the second slot (44) are arranged at two opposite sides of the second guiding slot (43).

4. The electronic cigarette as described in claim 3, wherein the first guiding slot (41) and the second guiding slot (43) are misaligned circumferentially.

5. The electronic cigarette as described in claim 3, wherein the first slot (42) and the second slot (44) are spaced longitudinally.

6. The electronic cigarette as described in claim 3, wherein the at least one latching protrusion (2151) comprises two latching protrusions (2151) opposite to each other, the first guiding slot (41), the first slot (42), the second guiding slot (43), and the second slot (44) respectively comprise two and are oppositely defined in two opposite sidewalls of the cartridge fixing element (40).

7. The electronic cigarette as described in claim 1, wherein the atomizer device (30) further comprises a seat (31), the cartridge fixing element (40) is arranged on an end of the seat (31) opposite to the cartridge (20) and extends towards a sidewall of the cartridge (20).

8. The electronic cigarette as described in claim 1, wherein the puncturing element (372) comprises at least one wedge-shape puncturing head (373) towards the sealing element (22).

9. The electronic cigarette as described in claim 8, wherein the puncturing head (373) comprises a blade (374) opposite to the first sealing portion (221), the blade (374) is arc shaped and extends circumferentially with the axis of the atomizer device (30) as the center.

10. The electronic cigarette as described in claim 9, wherein the puncturing head (373) comprises two opposite surfaces intersecting with each other to form the blade (374), the angle between the two opposite surfaces is acute.

11. The electronic cigarette as described in claim 1, wherein the cartridge (20) further comprises an elastic cover (23), the elastic cover (23) comprises a fixing portion (231) and a moveable portion (232) connected to the fixing portion (231), the fixing portion (231) is secured to the cartridge body (21), and the moveable portion (232) covers the opening (213) elastically.

12. The electronic cigarette as described in claim 1, wherein the atomizer device (30) further comprises an atomizer assembly (35), the atomizer assembly (35) comprises an absorption element and a heating element arranged on the absorption element, the absorption element is arranged within the snorkel (34) laterally and at least one end extends to the liquid reservoir room (315), the absorption element comprises a first absorption element (351) the dimension of the section of which is greater and two second absorption elements, the dimension of the section of each of the second absorption elements is smaller, and the second absorption elements are arranged above the first absorption element (351) side by side.

13. The electronic cigarette as described in claim 1, wherein the atomizer device (30) further comprises a first elastic sealing ring (38) arranged between the outer rings of the liquid reservoir chamber (212) and the liquid reservoir room (315).

14. The electronic cigarette as described in claim 11, wherein the cartridge body (21) comprises a pipe to separate the liquid reservoir chamber (212) from the smoke channel (211), the opening (213) and the elastic cover (23) are annular, the elastic cover (23) defines a center hole having a diameter slightly less than a diameter of the pipe, the elastic cover is tightly sleeved on a free end of the pipe, such that an inner ring of the elastic cover engages with the free end of the pipe to form the fixing portion; and an outer ring of the elastic cover extends laterally to a position near an inner sidewall of an outer ring of the liquid reservoir chamber (212) to form the moveable portion (232).

* * * * *